US009801438B2

(12) United States Patent
Delle Vedove

(10) Patent No.: US 9,801,438 B2
(45) Date of Patent: Oct. 31, 2017

(54) WALLET

(71) Applicant: Gaetano Delle Vedove, Pordenone (IT)

(72) Inventor: Gaetano Delle Vedove, Pordenone (IT)

( * ) Notice: Subject to any disclaimer, the term of this patent is extended or adjusted under 35 U.S.C. 154(b) by 244 days.

(21) Appl. No.: 14/375,925

(22) PCT Filed: Feb. 1, 2013

(86) PCT No.: PCT/IB2013/000133
§ 371 (c)(1),
(2) Date: Jul. 31, 2014

(87) PCT Pub. No.: WO2013/114193
PCT Pub. Date: Aug. 8, 2013

(65) Prior Publication Data

US 2014/0367005 A1 Dec. 18, 2014

(30) Foreign Application Priority Data

Feb. 3, 2012 (IT) ..... UD2012A0017

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01); *A45C 2001/065* (2013.01)

(58) Field of Classification Search
CPC .... A45C 1/06; A45C 11/182; A45C 2001/065
See application file for complete search history.

(56) References Cited

U.S. PATENT DOCUMENTS 1,635,940 A * 7/1927 Kanzel ..... A45C 1/06 150/132
2,151,465 A * 3/1939 Dalebrook ..... B65D 85/187 206/292
2,523,129 A * 9/1950 Maier ..... A45C 15/00 150/107
3,118,478 A * 1/1964 Metrick ..... A45C 1/06 150/136

(Continued)

FOREIGN PATENT DOCUMENTS

FR 872654 6/1942

OTHER PUBLICATIONS

International Search Report filed in PCT/IB2013/000133 dated Jun. 25, 2013.

*Primary Examiner* — Tri Mai
(74) *Attorney, Agent, or Firm* — Rankin, Hill & Clark LLP

(57) ABSTRACT

A wallet (10) comprises at least a wall (12) substantially rectangular and suitable to be bent at least along a main bending axis (P1), to define at least two main flaps (13*a*, 13*b*) positioned on opposite sides with respect thereto. At least a main containing element (26*a*, 26*b*) is attached on at least one surface (15*a*, 15*b*) of each of said main flaps (13*a*, 13*b*), so that each containing element (26*a*, 26*b*) defines at least a first pocket (27) having sizes such as to contain at least a standard-sized rectangular card (28). When the wallet is closed and the main flaps (13*a*, 13*b*) are bent one over the other along the main bending axis (P1), a main containing element (26*a*, 26*b*) attached on a determinate main flap (13*a*, 13*b*) is adjacent to, coplanar and therefore not overlapping, another main containing element (26*b*, 26*a*) attached on another main flap (13*b*, 13*a*).

2 Claims, 7 Drawing Sheets

(56) References Cited

U.S. PATENT DOCUMENTS

| | | | | | |
|---|---|---|---|---|---|
| D278,445 | S | * | 4/1985 | Hartney | D19/26 |
| D330,456 | S | * | 10/1992 | Lehman | D3/301 |
| 5,439,154 | A | * | 8/1995 | Delligatti | A45C 9/00 150/106 |
| D376,176 | S | * | 12/1996 | Buraczynski | D19/26 |
| D385,694 | S | * | 11/1997 | Magnussen | D3/201 |
| 6,802,348 | B2 | * | 10/2004 | Vernon | A45C 3/02 150/111 |
| D583,867 | S | * | 12/2008 | Powers | D19/113 |
| 2006/0039745 | A1 | * | 2/2006 | Menders | B42F 7/06 402/79 |
| 2011/0147152 | A1 | * | 6/2011 | Abdill | A45C 13/02 190/108 |

* cited by examiner

WALLET

FIELD OF THE INVENTION

The present invention concerns a wallet of the type with several compartments, into which can be inserted both bank notes and also standard-sized cards and personal documents, such as for example an identity card, invoices and receipts of payment or any other type of limited-size sheet.

BACKGROUND OF THE INVENTION

It is known that, in recent years, there has been an increasing use of cards, usually plastic, both by public institutions, private associations and commercial businesses, for the most varied purposes. For example, current driving licenses, tax code cards, health cards, credit and debit cards, bank cards, most season tickets for public transport, and also cards for collecting points or for obtaining discounts and promotions in commercial businesses: all these are of this type. Nearly all the above cards have a standard size, less than one millimeter thick and with a rectangular shape with a short side of 54 mm and a long side of 86 mm.

Due to the increasingly widespread use of cards, whereas until a few years ago in our wallets there were usually 3 or 4 cards, nowadays this number has at least doubled.

Known wallets have the disadvantage that they have a limited number of compartments or pockets for cards, and therefore, often, in the same pocket the user is obliged to insert two or more cards, one on top of the other. Consequently, more and more often, wallets really become very thick. There are also wallets on the market with partly overlapping pockets disposed on several rows: however, these are bulky and voluminous even when empty.

Furthermore, the disposition of the pockets for cards in known wallets has the disadvantage that they increase the reciprocal friction between the cards and between the cards and the pockets, impeding the removal thereof, especially of cards positioned deeper down.

Another disadvantage of known wallets is that their overall thickness, when they are closed, or folded back on themselves, and when they contain several cards, is given by the sum of the thickness of the walls that make up the wallet and the thickness of the cards contained therein: this thickness deforms and often damages the wallets themselves.

Furthermore, the excessive thickness of known wallets is not only unaesthetic and deforms the pockets of clothes where the wallets are disposed, such as trouser pockets or close-fitting jackets, but can also cause mechanical stresses on the cards, which can consequently bend and break. This is particularly important in cases where the wallet is kept in a back pocket of the trousers, and kept there even when the user is seated, as a large number of men tend to do.

The French patent FR-A-872.654 describes a wallet comprising three rectangular walls, parallel to each other and bent in their central zone along a common main bending axis. Each wall defines two flaps positioned on opposite sides with respect to the main bending axis. Five of the six flaps, in correspondence with their external edge, are bent to form five corresponding containing pockets which, when the wallet is closed, are all one on top of the other. The outermost wall of the wallet is provided with an additional closing wing and, in correspondence with this, it does not have a corresponding containing pocket. Therefore, this known wallet has the disadvantage that when it is closed it has a thickness equal at least to twelve times the thickness of a single wall, thus becoming very bulky. Furthermore, since in the closed position all the containing pockets overlap, the cards, or any other object contained therein, will also overlap.

One purpose of the present invention is to obtain a wallet, advantageously of the pocket type, which can easily contain a large number of cards, even more than 10, and possibly also bank notes, and which at the same time is not bulky even when it is full and folded over.

Another purpose of the present invention is to obtain a wallet in which it is easy to insert and remove the individual cards contained therein, irrespective of the number thereof.

It is also a purpose of the present invention to obtain a wallet in which the cards can be put securely, without them falling out of the corresponding pockets involuntarily, and without them being damaged by bending and/or insertion into or removal from the pockets.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a wallet according to the present invention comprises at least a main wall with a substantially rectangular development and configured to be bent at least along a main bending axis, to define at least two main flaps positioned on opposite sides of the main bending axis and each having at least a determinate rectangular surface. At least one main containing element is attached on the rectangular surface of each of the two main flaps, so that each main containing element defines at least a first pocket having shape and sizes such as to contain at least one card having a rectangular development with one short side and one long side of standard sizes. Furthermore, each main containing element has a surface that is equal to or less than half said determinate rectangular surface of each of the two main flaps.

According to a main characteristic of the present invention, each main containing element is attached on the corresponding determinate rectangular surface of one of the two main flaps, so as to be offset with respect to the main containing element adjacent to it, so that, when the two main flaps are bent over each other along the main bending axis, when the wallet is closed, the main containing elements are at least in coplanar pairs and therefore not overlapping each other.

According to a characteristic of the present invention, each main containing element has sizes such as to define two adjacent pockets to contain two adjacent cards.

According to one form of embodiment, the main wall of the wallet according to the present invention has a determinate height and is attached to another wall, or secondary wall, along three of its sides so as to define an inner pocket.

According to another characteristic of the present invention, the two first pockets are adjacent to each other in the direction of a long side of the card, so that the height of the wallet is equal to or greater than the sum of two short sides of a card, while the length of each main flap is equal to or greater than the long side of a card.

According to another characteristic of the present invention, each main containing element has a length substantially equal to or less than half the length of each of the main flaps.

According to a variant, each main containing element has a length substantially equal to or less than half the height of the wallet.

According to another characteristic of the present invention, at least one of the walls has sizes such as to also define at least a first secondary flap, positioned adjacent to one of the main flaps, and the first secondary flap can be bent over the main flap adjacent to it along a first secondary bending axis, parallel to the main bending axis. Furthermore, on at least one surface of the first secondary flap at least a first secondary containing element is attached which defines at least two second pockets each having sizes such as to contain a standard-sized card.

It is also within the scope of the invention to provide that at least one of the walls has sizes such as to also define at least a second secondary flap, positioned adjacent to one of the main flaps, on the opposite side to that where there is the first secondary flap described above, and that the second secondary flap can be bent over the main flap adjacent to it along a second secondary bending axis, parallel to the main bending axis. On one surface of the second secondary flap at least a second secondary containing element is attached, which defines at least two third pockets, each having sizes such as to contain a standard-sized card.

Each of the first and second secondary containing elements has a length substantially equal to or less than half the length of the secondary flaps.

According to another characteristic of the present invention, the first and second secondary containing elements are positioned on the aforesaid secondary flaps so that, when the latter are bent over the main flaps along the secondary bending axes, when the wallet is closed, the first and second secondary containing elements are each adjacent to and not overlapping the corresponding main containing element.

The wallet according to the present invention may comprise, attached on at least one of the secondary flaps, a third secondary containing element that defines at least two fourth pockets each having sizes such as to contain a standard-sized card.

The third secondary containing element is positioned on the external surface of the corresponding secondary flap opposite that where the corresponding second secondary containing element is disposed, so as not to overlap with the latter.

According to another characteristic of the present invention, on at least one of the secondary flaps a fourth secondary containing element is also attached, which defines at least a fifth pocket having sizes such as to contain a sheet or document with sizes double those of a standard-sized card, or a pair of standard-sized cards.

To obtain a limited bulk of the wallet according to the present invention, it is advantageous that each of the walls is made with a material having a thickness comprised between 0.5 mm and 1.5 mm, and that the length and height of each of the flaps are comprised respectively between 87 mm and 110 mm and between 110 mm and 130 mm.

In this way the advantage is obtained of containing the overall bulk of the wallet also when it is full, and also the advantage of preventing bulging that could lead to excessive stresses in the zone of attachment between the first and second wall or between the flaps and the respective containing elements, and thus cause deformations or damage to the wallet.

The adjacent disposition of the cards in the pockets and their position perpendicular to the axes of bending and to the direction of normal insertion of the wallet into the pocket of an article of clothing, advantageously allow to prevent the stresses acting on the cards from concentrating in the center thereof. In this way no damaging bending or breakages occur to the cards, for example when the wallet is put in a back pocket of the trousers.

BRIEF DESCRIPTION OF THE DRAWINGS

These and other characteristics of the present invention will become apparent from the following description of some preferential forms of embodiment, given as a non-restrictive example with reference to the attached drawings wherein.

In the following description, the same reference numbers indicate identical parts of the wallet according to the present invention, also in different forms of embodiment.

DETAILED DESCRIPTION OF SOME FORMS OF EMBODIMENT

Figure 1:
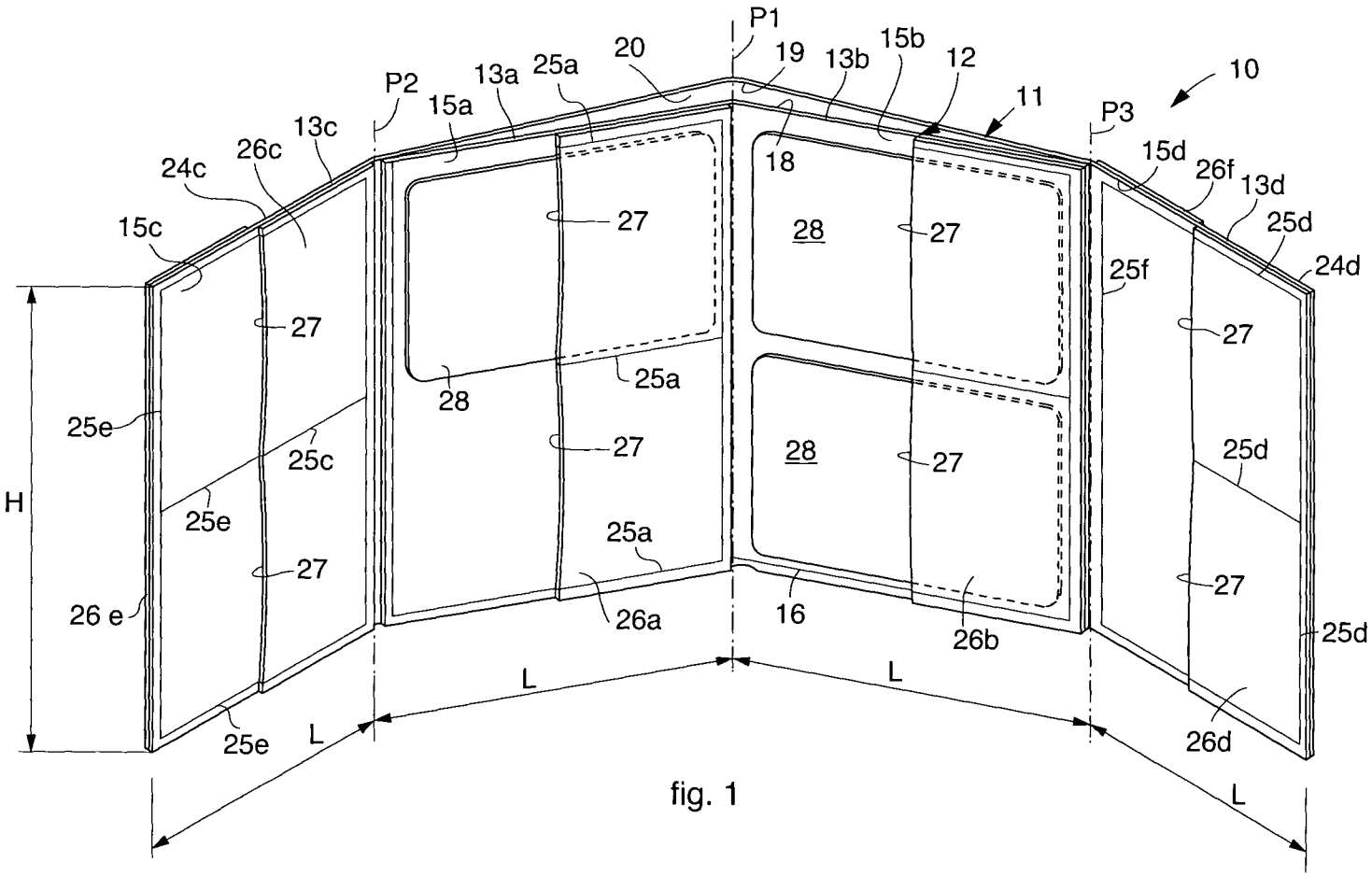
FIG. 1 is a front three-dimensional view of a wallet according to the present invention, in an intermediate open condition.
Figure 2:
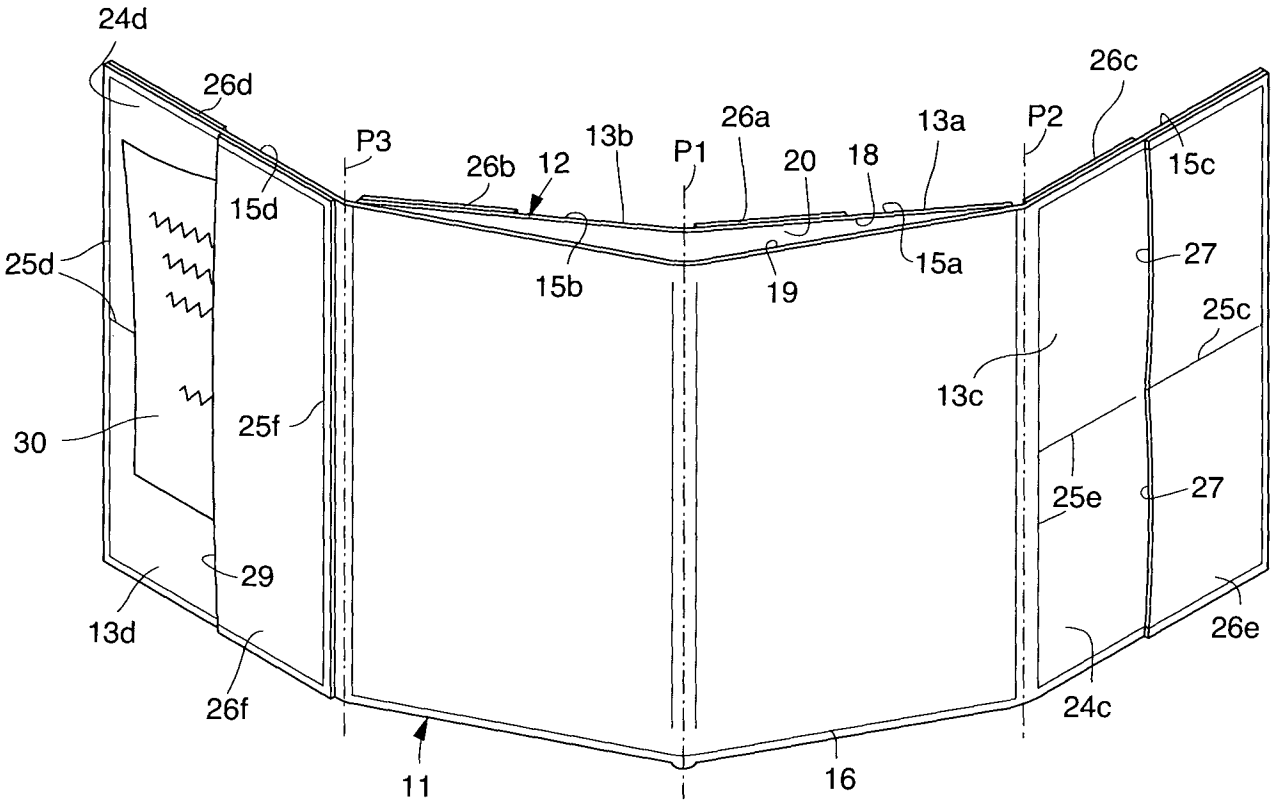
FIG. 2 is a back three-dimensional view of the wallet in FIG. 1.
Figure 3:
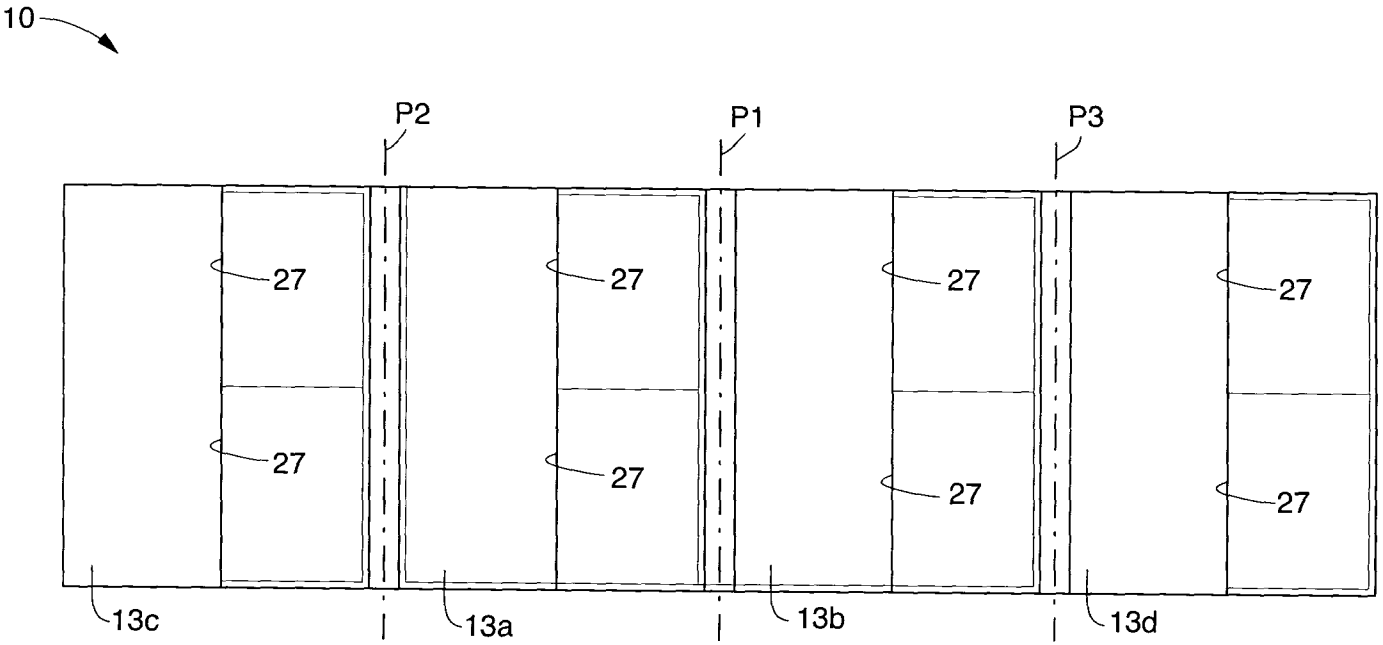
FIG. 3 is a front view of the wallet in FIG. 1.

With reference to FIGS. 1, 2, 3 according to a first form of embodiment, a wallet 10 according to the present invention comprises a first wall 11 and a second wall 12, both made of thin material, in this case leather with a thickness of 0.8 mm. The first wall 11 and the second wall 12 have a substantially rectangular longitudinal development, the same height H comprised between 110 mm and 130 mm and advantageously about 125 mm, and are reciprocally attached to each other.

The second wall 12 has a width which is about half that of the first wall 11 and is sewn at the front on the latter by means of a main stitch 16 which develops along three sides of the perimeter of the second wall 12, leaving one of its bigger sides free. In this way, the back surface 18 of the second wall 12 and the front surface 19 of the first wall 11 define a main pocket 20, suitable to contain for example bank notes of any size.

In this case, the first and second walls 11 and 12, joined together, are suitable to be bent longitudinally on themselves, to define four flaps 13*a*, 13*b*, 13*c* and 13*d*, rectangular in shape and all having substantially the same length L, comprised between 87 mm and 110 mm and advantageously about 95 mm.

The second wall 12, which in this case functions as a main wall, covers the longitudinal development of two flaps, in this case flap 13*a* and flap 13*b*, also called main flaps, positioned in a central position with respect to the first wall 11, that functions as a secondary wall.

The first wall 11 defines three bending axes P1, P2 and P3, parallel to each other and to the direction of normal insertion of the wallet into a user's pocket. Each bending axis P1, P2, P3 is interposed between pairs of adjacent flaps 13*a*-13*d*.

The axis P1 is also called the main bending axis, while axes P2 and P3 are also called secondary bending axes.

Figure 4:
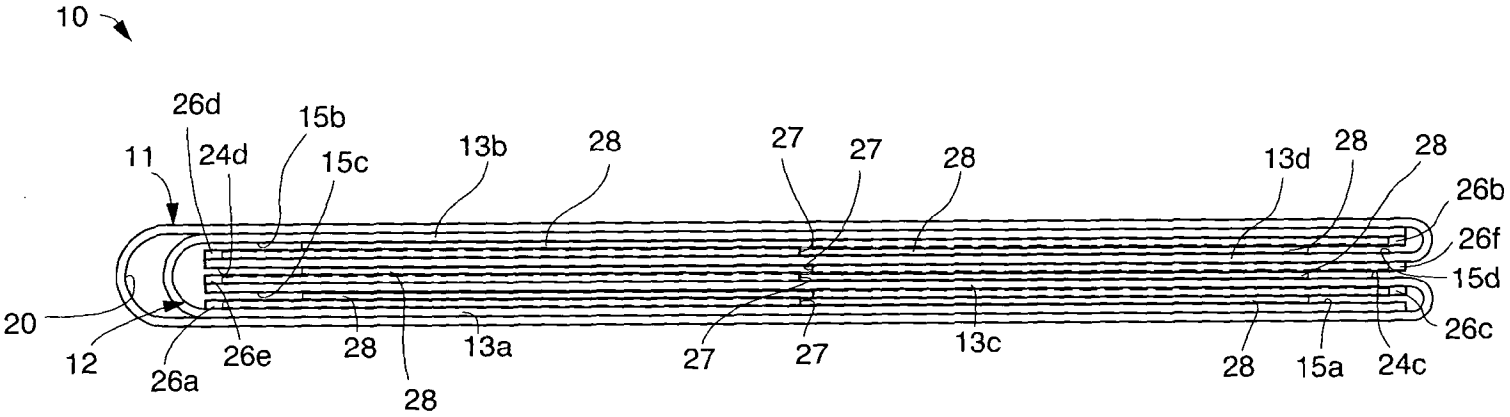
FIG. 4 is a plan view of the wallet in FIG. 1, in a closed and full condition.
Figure 5:
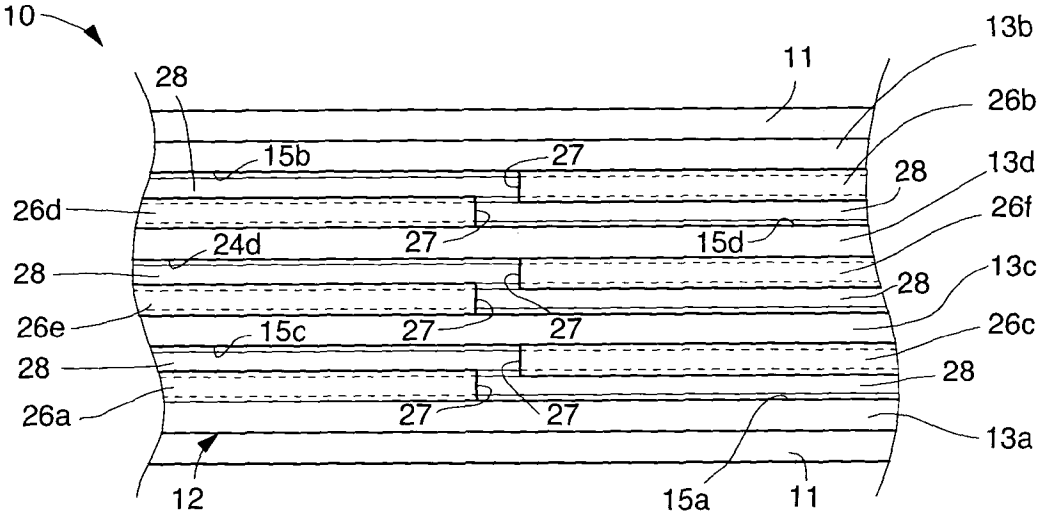
FIG. 5 is a detail of FIG. 4, on an enlarged scale.

The reciprocal angular positions of adjacent flaps 13*a*-13*d* define the intermediate open conditions that the wallet 10 can normally assume during use, and are comprised between a condition of maximum opening, in which the first wall 11 is completely spread out (FIG. 3), together with the second wall 12, and a closed condition or position (FIGS. 4 and 5) in which both the first and second walls 11 and 12 are completely bent back and the bending axes P2, P3 are overlapping, so that the longitudinal bulk of the wallet 10 is equal to the width L of each flap 13*a*-13*d*.

To keep the wallet 10 compact, and reduce its bulk even in the closed condition, it is advantageous to use materials with a thickness comprised between 0.5 mm and 1.5 mm.

The material and thicknesses indicated in the present description are given simply as examples, and there is nothing to prevent other materials from being used, such as natural or synthetic fabrics, or flexible plastic materials, also with thicknesses other than those indicated here.

Hereafter in the description, in order to understand the drawings better, the terms "front" and "back" will refer to the components of the wallet 10 based on their location with respect to the main pocket 20 during normal use of the wallet 10. In the same way, the external surfaces of the first and second walls 11 and 12 will be divided into front and back.

The flaps 13*a*, 13*b*, 13*c* and 13*d* identify respective front surfaces 15*a*, 15*b*, 15*c* and 15*d* (FIG. 1), which when the wallet 10 is in its maximum open condition (FIG. 3) are coplanar with respect to each other, whereas, in the closed condition (FIGS. 4 and 5), pairs of adjacent front surfaces 15*a*-15*d* face each other.

On each of the front surfaces 15*a*-15*d* (FIGS. 1 and 2) of the flaps 13*a*-13*d* a front block 26*a*, 26*b*, 26*c* and 26*d*, rectangular in shape, is applied by means of respective secondary stitches 25*a*, 25*b*, 25*c* and 25*d*, and for example made of the same material as the first wall 11 and the second wall 12. On each of the back surfaces 24*c* and 24*d* of the flaps 13*c* and 13*d* a back block 26*e*, 26*f* is applied by means of respective secondary stitches 25*e*, 25*f*, with the same shape and sizes as said front blocks 26*a*-26*d*. The back blocks 26*e*-26*f* can also be made of a different material from that of the two first and second walls 11, 12, but must be less thick than them, or have the same thickness.

Once positioned, the front 26*a*-26*d* and back blocks 26*e*, 26*f*, substantially occupy the whole height H and a little less than half the length L of the corresponding flap 13*a*-13*d* on which they are stitched, and function as containing elements.

In this case, five secondary stitches 25*a*-25*e* affect three sides of the perimeter of the corresponding front block 26*a*-26*d* or back block 26*e*, leaving one of its long sides free, and pass through the respective block 26*a*-26*e* transversely in correspondence with its center line, while the secondary stitch 25*f* affects only three sides of the perimeter of the back block 26*f*, leaving one of its long sides free but does not pass through it transversely. In this way, each of the five blocks 26*a*-26*e* defines, with the corresponding front surface 15*a*-15*d* or back surface 24*c* of the flaps 13*a*-13*d*, a pair of secondary pockets 27, each of which is suitable to contain a card 28 of a standard shape and sizes, while the back block 26*f* defines, with the back surface 24*d* of the flap 13*d*, a medium pocket 29, suitable to contain, for example, personal documents or one or more sheets 30, also bigger than the cards 28.

The cards 28 are rectangular in shape, defined by short sides 33 having a length of 54 mm and long sides 34 with a length of 86 mm. The cards 28 can be the plastic and/or magnetic type, used for example for bank credit or debit cards, for current identity cards and driving licenses, or for collecting points in many commercial businesses, while the sheets 30 can be for example invoices, receipts, tickets of various types, or paper identity cards or driving licenses.

Each card 28 is inserted into a smaller pocket 27 on the side of its short side 33 and in a direction orthogonal to the bending axes P1, P2, P3, so that the cards 28 housed in one flap 13*a*-13*d* of the wallet 10 have adjacent long sides 34.

The four front blocks 26*a*-26*d* are positioned on the same side of the respective front surfaces 15*a*-15*d* of the four flaps 13*a*-13*d*, as the back blocks 26*e*, 26*f* are positioned on the same side of the respective back surfaces 24*c* and 24*d*. The front blocks 26*c*, 26*d* and back blocks 26*e*, 26*f* of the same flap 13*c*, 13*d* are offset with respect to each other, so that the thicknesses of each pair of blocks 26*c*, 26*e* and 26*d*, 26*f* do not overlap.

The disposition of the blocks 26*a*-26*f* on the flaps 13*a*-13*d* and of the cards 28 in the smaller pockets 27 is such that, in the closed position (FIGS. 4 and 5), each front block 26*a*, 26*b* of the flaps 13*a*, 13*b* of the second wall 12 is positioned overlapping the zone of the front surface 15*c*, 15*d* of the respective adjacent flap 13*c*, 13*d* not affected by the presence of the corresponding block 26*c*, 26*d* and vice versa. If there are cards 28 in the smaller pockets 27, the front blocks 26*a*-26*d* are disposed substantially resting on the part of the card 28 that protrudes from the respective pocket 27 of the flap 13*a*-13*d* adjacent to that of the front block 26*a*-26*d* considered.

When the wallet 10 is closed, the back block 26*e* overlaps the zone of the back surface 24*d* of the flap 13*d* not affected by the presence of the back block 26*f* and the latter overlaps the zone of the back surface 24*c* of the flap 13*c* not affected by the presence of the back block 26*e*. In fact, similarly to the front blocks 26*a*-26*d*, the back blocks 26*e*, 26*f* also rest on the part of the card 28 or on the part of the sheet 30 that protrudes from the corresponding smaller 27 or medium pocket 29.

In this way, when the wallet 10 is closed, it is extremely compact, since the cards 28 or the sheets 30 of the same flap 13*a*-13*d* do not overlap, and the bulk of the wallet 10 is given substantially by the sum of the thicknesses of the material that makes up the first wall 11, the second wall 12 and the blocks 26*a*-26*f*. In this case, the thickness of the wallet 10 when closed is about 7.5 mm.

This orderly overlapping confers on the wallet 10 an overall bulk with a substantially parallelepiped shape, even when closed and even when all its pockets 20, 27, 29 are full, thus preventing bulging.

Figure 6:
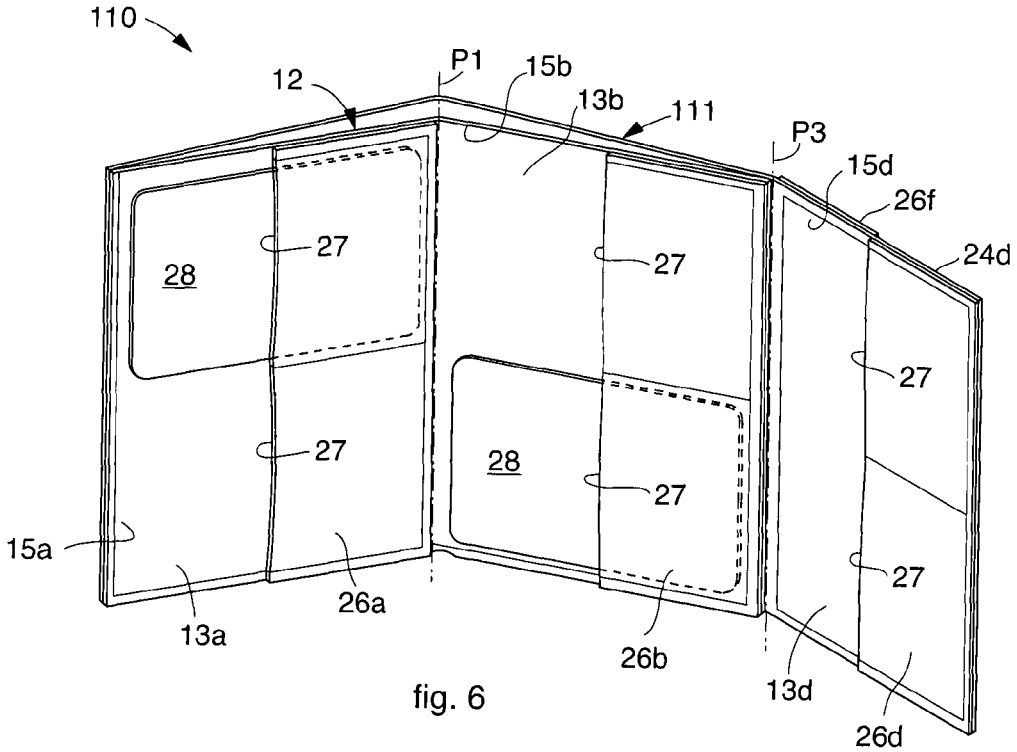
FIG. 6 is a three-dimensional view of a first variant of the wallet in FIG. 1.

According to a second form of embodiment of the present invention, shown in FIG. 6, a wallet 110 comprises a first wall 111 which defines three flaps 13*a*, 13*b*, 13*d* and two bending axes, corresponding to axes P1 and P3 in the variant described above.

In this second form of embodiment, when the wallet 110 is closed, the front block 26*d* is suitable to rest on the zone of the front surface 15*b* not affected by the front block 26*b*, while the latter is suitable to rest on the zone of the front surface 15*d* not affected by the front block 26*d*.

In the same way, the front block 26*a* is suitable to rest on the zone of the back surface 24*d* not affected by the back block 26*f*, while the latter is suitable to rest on the zone of the front surface 15*a* not affected by the front block 26*a*.

In this second form of embodiment, the wallet 110 can contain up to 8 cards 28, instead of the 12 cards 28 which the wallet 10 of the variant shown in FIGS. 1-5 can contain at most.

Figure 7:
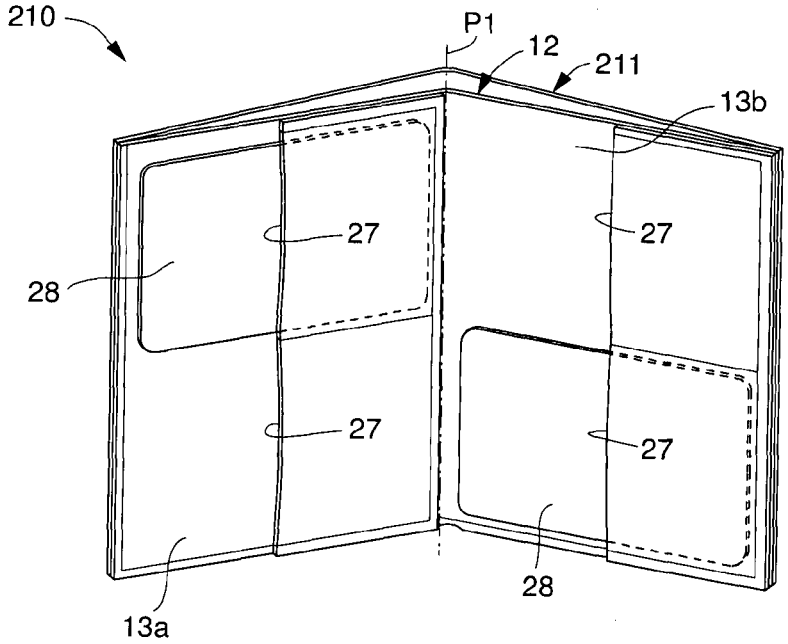
FIG. 7 is a three-dimensional view of a second variant of the wallet in FIG. 1.
Figure 8:
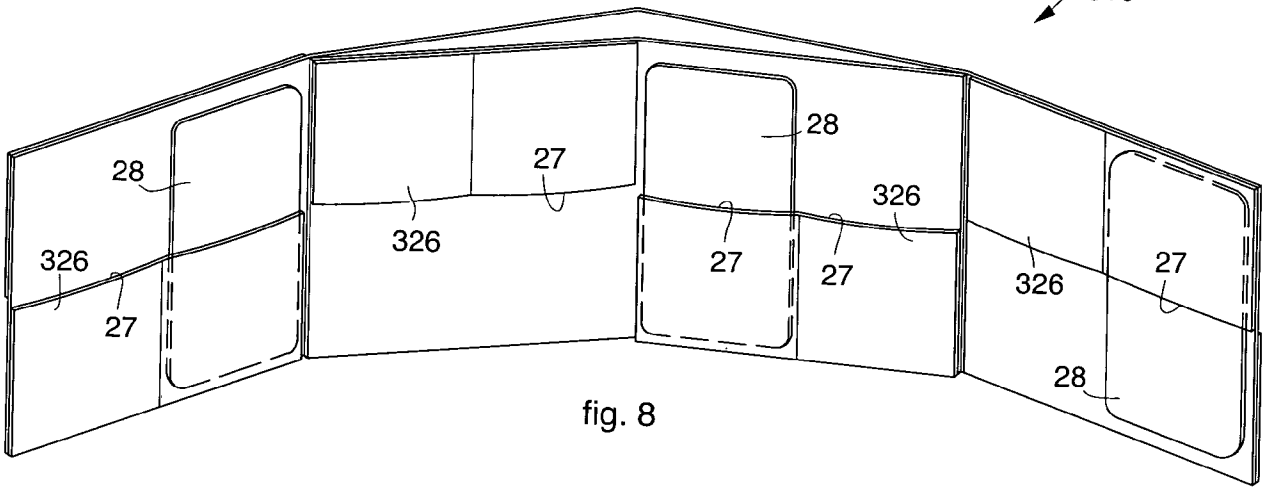
FIGS. 8 to 12 show some other variants of wallets according to the present invention.
Figure 9:
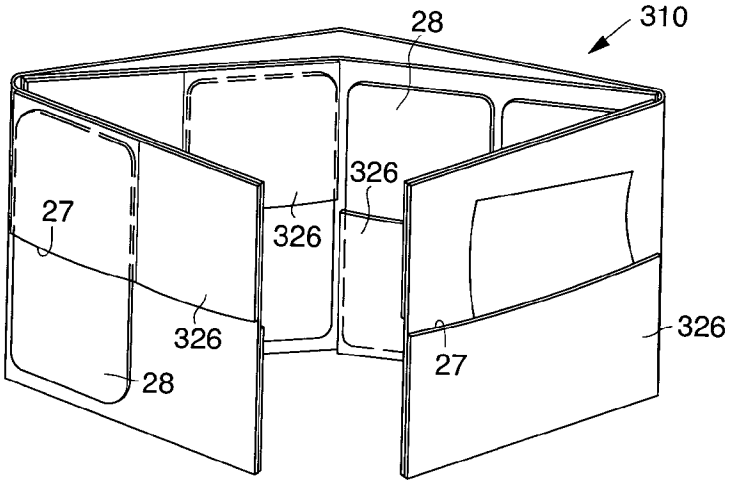
Figure 10:
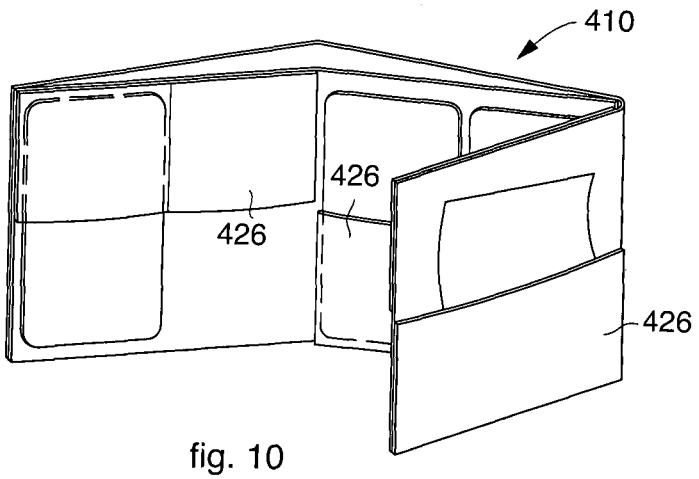
Figure 11:
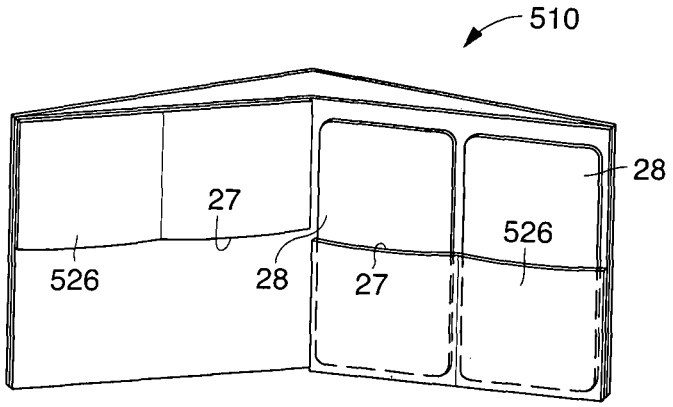
Figure 12:
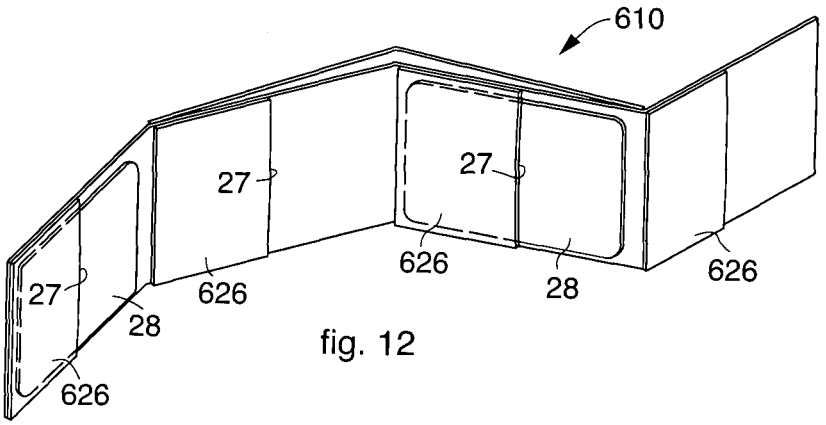

According to another form of embodiment of the present invention, shown in FIG. 7, a wallet 210 comprises a first wall 211, having the same size as the second wall 12, which defines only two flaps 13*a*, 13*b* and a single bending axis, corresponding to the axis P1 of the forms of embodiment described above. When the wallet 210 is closed, the front block 26*a* is suitable to rest on the zone of the front surface 15*b* not affected by the front block 26*b*, while the latter is suitable to rest on the zone of the front surface 15*a* not affected by the front block 26*a*.

In this other form of embodiment, the wallet 210 can contain up to 4 cards 28.

FIGS. 8 to 12 show other forms of embodiment of wallets 310, 410, 510 and 610 according to the present invention, in which the containing element 326, 426, 526 and 626 that define the pockets 27 are disposed in different positions, but all coming within the inventive idea of the present invention that they do not overlap, or overlap as little as possible, at least in pairs, as will easily be understood by the person of skill.

It is clear that modifications and/or additions of parts may be made to the wallets 10, 110, 210, 310, 410, 510, 610 as described heretofore, without departing from the field and scope of the present invention.

For example, an internal pocket can be made inside the biggest pocket 20, to divide the biggest pocket 20 into two compartments.

Furthermore, closing means may be provided, such as for example automatic buttons, or one or more strips such as Velcro® or a zipper, which keep the wallets 10, 110, 210 firmly in a closed condition, to prevent them from accidentally losing their content.

It is also clear that, although the present invention has been described with reference to some specific examples, a person of skill in the art shall certainly be able to achieve many other equivalent forms of wallet, having the characteristics as set forth in the claims and hence all coming within the field of protection defined thereby.

The invention claimed is:

1. A pocket type wallet comprising:

a first rectangular wall and a second rectangular wall which have a same height between 110 mm and 130 mm, and a same thickness between 0.5 mm and 1.5 mm;

wherein said second rectangular wall has a width which is half that of said first rectangular wall;

wherein said first rectangular wall and said second rectangular wall are jointed together and define four rectangular flaps rectangular in shape and all having substantially the same length between 87 mm and 110 mm;

wherein said second rectangular wall comprises:

a first rectangular main flap of said four rectangular flaps, comprising a first rectangular front surface;

a second rectangular main flap of said four rectangular flaps, having substantially the same dimensions of said first rectangular main flap, comprising a second rectangular front surface, and being connected to said first rectangular main flap along a main bending axis;

wherein said first rectangular wall comprises:

a first rectangular secondary flap of said four rectangular flaps, having substantially the same dimensions of said first rectangular main flap, comprising a third rectangular front surface, and being connected to said first rectangular main flap along a first secondary bending axis parallel to said main bending axis; and a second rectangular secondary flap of said four rectangular flaps, having substantially the same dimensions of said second rectangular main flap, comprising a fourth rectangular front surface, and being connected to said second rectangular main flap along a second secondary bending axis parallel to said main bending axis;

wherein said pocket type wallet is configured to assume a maximum opening condition, in which said four rectangular flaps are substantially coplanar therebetween, and a closed condition in which said four rectangular flaps are substantially parallel therebetween, with said third rectangular front surface facing said first rectangular front surface, and with said fourth rectangular front surface facing said second rectangular front surface;

wherein a first rectangular containing element is attached on said first rectangular front surface, a second rectangular containing element is attached on said second rectangular front surface, a third rectangular containing element is attached on said third rectangular front surface, and a fourth rectangular containing element is attached on said fourth rectangular front surface;

wherein each of said four rectangular containing elements has a surface that is equal to or half of each of said rectangular front surface and defines a corresponding first rectangular pocket shaped and sized to contain at least one associated card having a rectangular shape; and wherein said four rectangular containing elements are attached on said rectangular front surfaces in such a manner that said first rectangular containing element is offset with respect to said third rectangular containing element, and said second rectangular containing element is offset with respect to said fourth rectangular containing element, so that when said pocket type wallet is in said closed condition, with said first rectangular secondary flap bent back on said first rectangular main flap along said first secondary bending axis, with said second rectangular secondary flap bent back on said second rectangular main flap along said second secondary bending axis, and with said first rectangular main flap and said second rectangular main flap bent back one on the other along said main bending axis, said first rectangular containing element is coplanar to said third rectangular containing element and therefore not overlapping each other, and said second rectangular containing element is coplanar to said fourth rectangular containing element and therefore not overlapping each other.

2. A wallet according to claim 1, wherein each of said four rectangular containing elements defines two of said first rectangular pockets, adjacent to each other, to contain two associated cards adjacent each other along their long side.

* * * * *